United States Patent [19]

Horie et al.

[11] 4,061,098

[45] Dec. 6, 1977

[54] PROCESS FOR BENDING METAL SHEET

[75] Inventors: Koji Horie, Toyota; Takashi Mune, Anjo, both of Japan

[73] Assignees: Toyota Jidosha Kogyo Kabushiki Kaisha; Hosei Brake Industry Company, both of Japan

[21] Appl. No.: 769,429

[22] Filed: Feb. 17, 1977

[30] Foreign Application Priority Data

Aug. 27, 1976 Japan ..... 51-101715

[51] Int. Cl.[2] ..... B21C 37/02

[52] U.S. Cl. ..... 113/116 Q; 72/352; 72/379

[58] Field of Search ..... 113/116 Q, 116 R, 116 AA; 72/367, 356, 384, 377, 379, 369, 702, DIG. 16, 352

[56] References Cited

U.S. PATENT DOCUMENTS

| | | | |
|---|---|---|---|
| 1,888,891 | 11/1932 | Schmidt | 72/369 |
| 2,830,645 | 4/1958 | Huet | 72/367 |
| 3,013,451 | 12/1961 | Scribner | 72/377 |
| 3,540,252 | 11/1970 | Pfanner | 72/379 X |
| 3,857,270 | 12/1974 | Iten | 72/379 X |

*Primary Examiner*—Leon Gilden

*Attorney, Agent, or Firm*—Kane, Dalsimer, Kane, Sullivan and Kurucz

[57] ABSTRACT

A process for bending on a press a metal sheet through a desired angle and an inner bend radius less than the thickness of the sheet, without causing damages such as cracking in a bend. According to this process, a metal sheet is first bent through an angle approximating a desired angle, with an inner bend radius being greater than the thickness of the metal sheet, and then the metal sheet thus bent is further bent through a desired angle, with the inner bend radius being less than the thickness of the metal sheet, and with the stretching of a material of the metal sheet on the outer side of the bend being suppressed.

6 Claims, 8 Drawing Figures

PROCESS FOR BENDING METAL SHEET

BACKGROUND OF THE INVENTION

1. Field of the Invention

This invention relates to a process for bending a metal sheet, and more particularly to a process for bending a metal sheet through a desired angle, with the inner bend radius being less than the thickness of the metal sheet, without causing damages such as cracking in a bend.

2. Description of the Prior Art

Known as one of processes for bending a metal sheet is one which uses a press having a punch and a die.

According to the above process, a metal sheet may be bent through a desired inner bend radius i.e., an inner radius of curvature for a desired bend. However, the above bending process suffers from a shortcoming that upon bending, the neutral plane, i.e., an imaginary neutral plane of a metal sheet, where neither stretching nor compression takes place, tends to shift inwardly of a bend, as an inner bend radius decreases. For this reason, the bending of a metal sheet according to a press through inner bend radius less than the thickness of a metal sheet results in an increase in elongation of a material of the metal sheet on its outer side of a bend, causing damages such as cracking and the like in the outer surface of a bend. This is particularly true with the bending of a metal sheet which affords low ductility, such as for instance, a high tensile rolled steel plate. Thus, considerable difficulty is encountered with the bending of a metal sheet of a low ductility through an inner bend radius less than the thickness of a metal sheet, while preventing damages in a bend of the sheet.

SUMMARY OF THE INVENTION

It is a principal object of the present invention to provide a process for bending a metal sheet through a desired angle and inner bend radius, without causing damages or failure in the outer surface of a bend.

It is another object of the present invention to provide a process for bending a metal sheet, which affords a relatively low ductility, through a desired angle, with an inner bend radius being less than the thickness of a metal sheet without causing damages.

The present invention is based on a finding that damages such as cracking in the outer surface of a bend of a metal sheet, which take place in a press-bending process, are attributable to excessive elongation of the outer surface of a bend, particularly when a metal sheet is bent through inner bend radius greater than the thickness of the metal sheet, and that the bending through an inner bend radius greater than the thickness of a metal sheet will not result in an excessive elongation of a material in the outer surface of a bend to an extent to cause the aforesaid damages.

According to the present invention, there is provided a process for bending a metal sheet, which process includes the steps of bending a metal sheet through an angle approximating a desired angle, with an inner bend radius being greater than the thickness of a metal sheet, and then further bending same on a press through a desired angle, with an inner bend radius being less than the thickness of a metal sheet, and with the stretching of a material of the metal sheet on the outer side of a bend being suppressed.

More particularly, according to the process of the invention, a metal sheet is bent through an angle approximating a desired angle, with an inner bend radius being greater than the thickness of a metal sheet beforehand, and then the metal sheet thus bent is further subjected to bending on a press through a desired angle and inner bend radius, with the opposite side-edges of the metal sheet being fixedly held. Since the side-edges of a metal sheet are fixedly held in the press by stoppers or shoulder portions of a die by the cooperation of a pressing surfaces of a punch, a material of the metal sheet on the outer side of a bend will not be elongated to an extent to cause damages or cracking in the outer surface of a bend, even if the metal sheet is bent through an inner bend radius less than the thickness of a metal sheet.

BRIEF DESCRIPTION OF THE DRAWINGS

A process for bending a metal sheet according to the present invention comprises two steps. In the first step, as shown in FIG. 1, a metal sheet 10 having a uniform thickness $t$ is subjected to a preliminary bending. According to the above preliminary bending, the metal sheet 10 is bent through a desired plane angle $\theta$, with an inner bend radius being equal to the thickness $t$ of the metal sheet 10 and an outer bend radius being about two times greater than the thickness $t$ of the metal sheet. In this respect, the plane angle $\theta$ is defined as an angle formed by surfaces leading to side edges 12, 14 of the metal sheet 10, and an angle $\theta$ of 90° is shown in FIG. 1. The above preliminary bending may be accomplished by using a bending press. As shown in FIG. 2, the plane angle $\theta$ may be reduced to an angle smaller than 90°. In addition, a metal sheet may be bent through a desired plane angle $\theta$ so as to provide a somewhat outwardly projecting bend.

The inner and outer bend radii of the bend obtained according to the preliminary bending step may be further increased as compared with the thickness $t$ and $2t$, respectively, to an extent that the plane angle $\theta$ will not be excessively larger than a given angle, with the opposite side-edges of a metal sheet being fixedly held in a press in the second step to be described. According to the first step of bending, the neutral plane, i.e., an imaginary neutral plane where neither stretching nor compression takes place, will not shift inwardly of a bend. For this reason, a high tensile rolled steel plate or sheet having relatively low ductility will not be elongated so as to cause cracking in the outer surface of a bend in the preliminary bending step.

Figure 1:
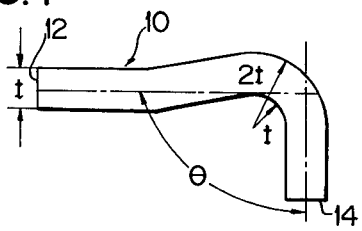
FIG. 1 to FIG. 3 are side views of metal sheets which are bent beforehand according to the present invention.
Figure 2:
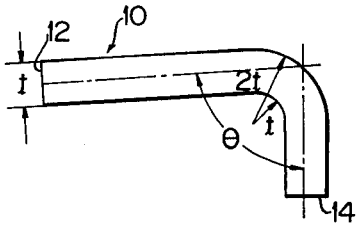
Figure 4:
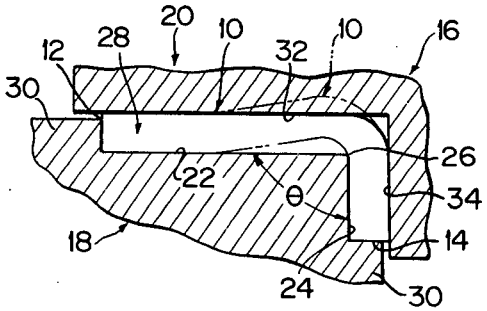
FIG. 4 and FIG. 5 are longitudinal, partial cross sectional views showing the embodiments of a press practicing the process of the invention, respectively.

Following the first step of bending, the metal sheet 10 is placed between a punch and a die for further bending through a desired angle, with an inner bend radius being less than thickness $t$ of the metal sheet, with the opposite side-edges of the metal sheet 10 being fixedly held against shoulder portions of a die in cooperation with the pressing surfaces of a punch in a press. The press referred to herein as at 16 includes a die 18 and a punch 20 adapted to be lowered onto the die 18, as shown in FIG. 4. The die 18 includes a desired plane angle $\theta$, in FIG. 4, which is in the embodiment shown, thereby providing an edge 26 having a desired radius of curvature less than the thickness $t$ of the metal sheet 10. In addition, the surfaces 22, 24 include metal-sheet-bearing portion 28, on which is placed the metal sheet 10 which has been preliminarily bent into a shape shown in FIG. 1 according to the first step as shown by a two point chain line in FIG. 4. The metal-sheet-bearing portion 28, however, forms part of the surfaces 22, 24 and is formed with shoulder portions 30, 30, against which the opposite side-edges 12, 14 of the metal sheet 10 are urged during the bending operation according to the second step. The punch 20 is formed with pressing surfaces 32, 34 in parallel with said horizontal surface 22 and vertical surface 24, pressing the metal sheet 10 against the surfces 22, 24 of the die 18, with the opposite side-edges 12, 14 being urged against the shoulder portions 30, 30. In this respect, the side edge portions of the metal sheet 10 are rigidly held against the shoulder portions 30, 30, respectively.

Accordingly, the metal sheet 10 is bent along the edge 26 of the metal-sheet-bearing portion 28 by means of the punch 20 and die 18 cooperative therewith through an inner bend radius less than the thickness $t$ of the metal sheet 10, with the side portions of the metal sheet 10 being pressed between the surfaces 22, 24 of the die 18 and the pressing surfaces 32, 34 of the punch 20. In this manner, the metal sheet 10 may be bent through a desired angle and inner bend radius. In this case, the opposite side-edges 12, 14 of the metal sheet 10 are held against their displacement by the shoulder portions 30 by being urged against same, so that the outer surface of a bend of the metal sheet 10 will not be stretched to an extent to cause cracking, nor will shift the neutral plane of the metal sheet 10 inwardly of a bend.

Figure 3:
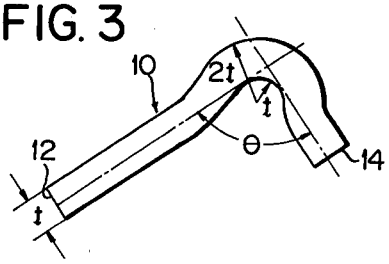
Figure 5:
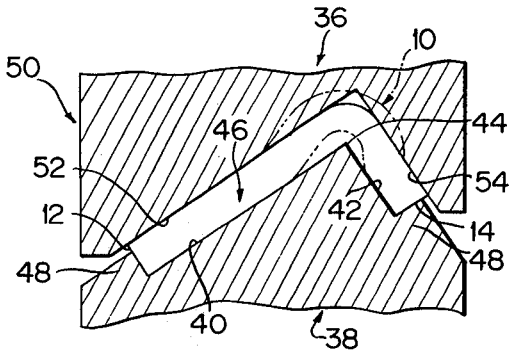

FIG. 5 shows another embodiment of the invention which uses a press for bending of a metal sheet. A die 38 in a press 36 has a desired plane angle formed by two inclined surfaces 40, 42, and metal-sheet-bearing portion 46 which forms part of the surfaces 40, 42. The die 38 has an edge 44 similar to that shown in FIG. 4. The die 38 is formed with shoulder portions 48 which arrest the opposite side-edges of the metal sheet 10 against their displacement, when pressed or bent. As shown by two-point chain line in FIG. 5, the metal sheet 10 has been bent according to the preliminary bending step into a shape as shown in FIG. 3. On the other hand, a punch 50 is formed with pressing surfaces 52, 54 which are cooperative with the inclined surfaces 40, 42 of the die 38 for pressing and bending of the metal sheet 10.

In the same manner as that given in the preceding embodiment of the invention, the metal sheet 10 may be bent through a desired angle, with an inner bend radius being less than the thickness $t$ of the metal sheet 10 without causing cracking, with the opposite side-edges 12, 14 of the sheet 10 being fixedly held against the shoulder portions 48 of the die 38 by the cooperation of the pressing surfaces 52, 54 of the punch 50.

While description has been given of examples, wherein a metal sheet is bent through 90°, a metal sheet may be bent through a desired angle by varying the plane angle $\theta$ of the metal sheet according to the preliminary bending step (first step), an angle formed by surfaces 22, 24 or 40, 42 of the die 18 or 38, and an angle formed by the pressing surfaces 32, 34 or 52, 54 of the punch 20 or 50. In addition, even in case the thickness of a metal sheet is not uniform over its entire width, the metal sheet may be bent through an inner bend radius less than the thickness of the bend of the metal sheet by providing those surfaces of a die and pressing surfaces of a punch, which well match with said irregular thickness of the metal sheet. In this case, damages in the outer surface of a bend may be prevented likewise.

Figure 6:
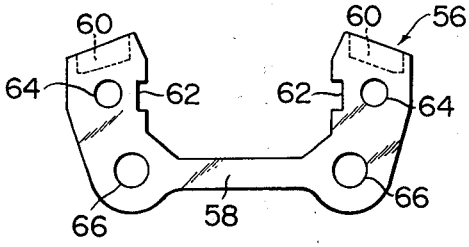
FIG. 6 and FIG. 7 are a front view and a side view of a torque bearing member formed according to the bending process of the invention, respectively.
Figure 7:
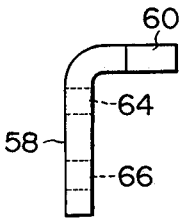

FIGS. 6 and 7 show a torque-bearing member 56 for use in a disc brake, which member has been formed according to the present invention. As shown in FIG. 6, the torque bearing member 56 consists of a "U" shaped fixing or body portion 58 and a pair of outer pad guide portions 60 which extend from the opposite ends of the "U" shaped fixing portion at a right angle to the fixing portion 58. The fixing portion 58 is provided with inner-pad guiding cut-away portions 62 to be described later in its opposing inner edges, and threaded holes 64, 66, upper and lower, in the side portions of the fixing portion 58, respectively. The torque-bearing member 56 is made of a high tensile strength rolled steel plate and formed by bending same according to the process of the invention through an inner bend radius less than the thickness of a steel plate. More particularly, the end portions of the fixing portion 58 are bent through an angle of 90° to give guide portions 60.

Figure 8:
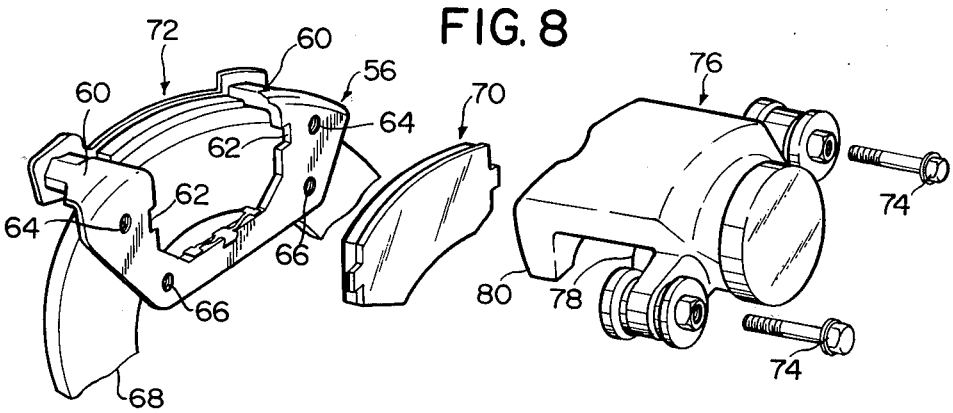
FIG. 8 is a perspective exploded view of a disc brake including a torque bearing members shown in FIGS. 6 and 7.

As shown in FIG. 8, the torque member 56 is positioned in the close vicinity of the peripheral edge portion of a brake disc 68 having a rotary shaft (not shown), as in a prior art disc brake. The torque bearing member 56 is secured to a frame (not shown) of an automotive body by means of bolts (not shown) threaded into said threaded holes 66, in a manner that the outer pad guide portions 60 are parallel with the rotary shaft of the brake disc 68. Fitted in the cut-away portions 62 in the torque bearing member 56 positioned on one side of the brake disc 68 is an inner pad 70, which is slidable relative to the rotary shaft therealong. In addition, an outer pad 72 is positioned on the other side of the brake disc 68, being fitted in the outer pad guide portions 60 in a manner to be slidable along the rotary shaft. Threaded into threaded holes 64 in the torque bearing member 56 are pins 74 which extend along the rotary shaft of the brake disc 68, while a caliper 76 is supported by the pins 74 slidingly. As in the prior art caliper, the caliper 76 is provided with a piston 78 adapted to urge the inner pad 70 from one side against the brake disc 68, and a pad pressing portion 80 adapted to urge the outer pad 72 from the other side against the brake disc 68. When the piston 78 forces the inner pad 70 against the brake disc 68 as in a well known manner, then the pad pressing portion 80 of the caliper 76 forces the outer pad 72 against the brake disc 68 by the reaction of said piston 78. Accordingly, the rotating brake disc 68 is braked by the pads 70, 72 which sandwich the disc 68 therebetween. Upon braking action, the pads 70, 72 bear a rotational force of the brake disc 68, and the force thus borne by the pads is then borne by the torque bearing member 56.

Hitherto, a torque bearing member for use in a disc brake has been manufactured according to the forging or casting, rather than press-forming of a sheet metal. This is because the inner bend radius of bends formed between the fixing portion 58 and guide portions 60 can not be reduced enough for receiving the edge of the brake disc 68, as has been described earlier. Stated differently, according to the prior art bending process, it has been found difficult to bend a metal sheet through an inner bend radius less than the thickness of a metal sheet, and there tends to take place damages such as cracking in bends of a torque bearing member. This is apparently not preferable, because a large force acts on the torque bearing member, upon braking operation.

This is the reason why a torque bearing member has been forged or cast. However, a forged or cast torque bearing member dictates finishing working for achieving a high surface-precision, with an accompanying increase in weight of a brake device.

In contrast thereto, a torque bearing member prepared according to the present invention is light in weight and high in strength, because of the use of a high tensile steel plate. In addition, a high tensile steel plate may be bent through an inner bend radius less than the thickness of a metal sheet, with the freedom of damages such as cracking in a bend. This may save the weight of a disc brake and dispenses with the finishing working, with the result of reduction in cost.

As is apparent from the foregoing description of the bending process of the invention, the stretching of a material on the outer side of a bend may be suppressed in the second bending step of the process using a press, so that a high tensile steel plate and the like having relatively low ductility may be bent through an inner bend radius less than the thickness of a metal sheet, without causing cracking in a bend.

Thus, the forged or cast torque bearing member may be well substituted by a torque bearing member made of a metal sheet according to the present invention, with the improvements in weight and cost, because of the use of a high tensile steel plate.

The foregoing examples are presented herein for illustrative purposes only and are not intended to unduly limit the scope of the invention. 9n

We claim:

1. A process for bending a metal sheet in manufacture of a torque bearing member for a disc brake, comprising the steps of:

bending a metal sheet through an angle approximating a right angle, with an inner bend radius being greater than the thickness of said metal sheet; and further bending the bent portion of said metal sheet by using a press through a right angle, with an inner bend radius being less than the thickness of said metal sheet, and with the opposite side-edges of said metal sheet being held fixedly, said formed disc brake torque bearing member thus shaped to form part of an assembly including, an inner pad and an outer pad arranged on the opposite sides of a brake disc having a rotary shaft, and a caliper for urging said pads against said brake disc, and said torque bearing member formed to include: a 'U' shaped fixing or body portion extending along one side surface of said brake disc towards the peripheral edge of said disc; and opposite side-portions extending from the opposite sides of said fixing portion over the peripheral edge of said disc transversely outwardly and provided with a pair of guide portions for guiding an outer pad slidingly, said fixing portion forming right angled bends with said outer pad guiding portions, respectively.

2. A process for bending a metal sheet set forth in claim 1, wherein said metal sheet is a high tensile rolled steel plate.

3. A process for bending a metal sheet as set forth in claim 1, wherein said press includes a die and a punch to be pressed against said die, said die having two intersecting, sheet-bearing surfaces forming a right angled edge, which bears said firstly bent metal sheet therealong, each sheet bearing surface providing with a shoulder portion at its extreme edge, and said punch having pressing surfaces in parallel with said intersecting surfaces, whereby such portions of said metal sheet which correspond to said fixing portion and said outer-pad guiding portion may be fixedly held against said shoulder portions.

4. A process for bending on a press a metal sheet through a desired angle and an inner bend radius less than the thickness of said sheet, comprising the steps of:

bending said metal sheet through an angle approximating a desired angle, with an inner bend radius being greater than the thickness of said metal sheet; and further bending said metal sheet thus bent through a desired angle, with an inner bend radius being less than the thickness of said metal sheet, and with the opposite side-edges of said metal sheet being held fixedly, thereby providing partial damages in a bend thus formed.

5. A process for bending a metal sheet as set forth in claim 1, wherein said metal sheet is a high tensile steel plate.

6. A process for bending a metal sheet as set forth in claim 1, wherein said press includes a die and a punch to be pressed against said die, said die having two intersecting, sheet-bearing surfaces providing a right angled edge, which bears said firstly bent metal sheet therealong, each sheet-bearing surface providing with a shoulder portion at its extreme edge, and the side-edges of said metal sheet being fixedly held against said shoulder portions.

* * * * *

UNITED STATES PATENT OFFICE
CERTIFICATE OF CORRECTION

PATENT NO. 4,061,098

DATED December 6, 1977

INVENTOR(S) KOJI HORIE and TAKASHI MUNE

It is certified that error appears in the above-identified patent and that said Letters Patent are hereby corrected as shown below:

Column 6, line 40, "claim 1" should be --claim 4--; and

Column 6, line 43, "claim 1" should be --claim 4--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*